US007087001B1

(12) United States Patent
Ihli

(10) Patent No.: US 7,087,001 B1
(45) Date of Patent: Aug. 8, 2006

(54) PORTABLE HANDHELD EXERCISE APPARATUS WHICH CAN BE ATTACHED TO A MULTIPLICITY OF BODY PARTS

(76) Inventor: Stephen P. Ihli, 423-D San Vicente Blvd., Santa Monica, CA (US) 90402

( * ) Notice: Subject to any disclaimer, the term of this patent is extended or adjusted under 35 U.S.C. 154(b) by 489 days.

(21) Appl. No.: 10/329,071

(22) Filed: Dec. 24, 2002

(51) Int. Cl.
*A63B 21/015* (2006.01)

(52) U.S. Cl. ..... 482/115; 482/44; 482/74; 482/79; 119/795; D30/153

(58) Field of Classification Search ..... 482/115, 482/44–49, 74, 79, 121–130, 51–55, 139, 482/72, 907, 102; D30/153; D21/665, 674, D21/684–685, 694, 704, 753, 771; 119/795
See application file for complete search history.

(56) References Cited

U.S. PATENT DOCUMENTS

| | | | |
|---|---|---|---|
| 766,743 | A | 8/1904 | Terry |
| 913,799 | A | 3/1909 | Burguet |
| 1,573,362 | A | 2/1926 | Stovall |
| 3,841,627 | A | 10/1974 | Vetter |
| 3,885,789 | A | 5/1975 | Deluty |
| D241,150 | S | 8/1976 | Hale |
| 4,174,832 | A | 11/1979 | Thompson |
| 4,328,965 | A | 5/1982 | Hatfield |
| D304,748 | S | 11/1989 | Bowers |
| 5,358,461 | A | 10/1994 | Bailey |

(Continued)

*Primary Examiner*—Lori Amerson
(74) *Attorney, Agent, or Firm*—Thomas I. Rozsa; Tony D. Chen

(57) ABSTRACT

The present invention is directed to a portable personal training and exercise device with a cable and pulley mechanism which also is a mobile personal training and exercise device having an ergonomic plastic external housing that with the use of straps fits in the hand as well as against different parts of the body. The present invention has a cable and pulley mechanism inside a housing which has a pulley rotatably mounted on a shaft that spins in only one direction. The pulley spins in both directions so that it is spring biased for rewinding a cord onto the pulley. Next to the pulley is a brake wheel or brake bushing that is attached to the shaft. The brake wheel or brake bushing and a pulley spinning on a single shaft inserts into a sealed ball bearing on both ends. A spring is connected to the bottom of the pulley. In the center of the pulley is a combination ball bearing/one-way clutch that turns the shaft only in one direction. The shaft is attached to the brake wheel or brake bushing. Secured around the outer edge of the brake wheel is a brake band. Secured around the outer edge of the brake bushing is a brake clamp. The brake band or brake bushing can be tightened for variable resistance through a tension adjustment assembly including a tension bolt. There is also a multi-directional guide unit mounted on the housing for allowing the pulley cords to be pulled in multiple directions with variable amounts of friction. The cord, which is wrapped around the pulley, emerges through a multi-directional bearing that rotates 360 degrees, thus allowing full range of three dimensional motion. Therefore, a user may pull the cords of the pulley for exercising various muscles of the user and adjust the resistance force of the cord at an appropriate level from the user. Different attachments can be connected to the snap at the end of the cord or cable such as a grip handle, wrist strap, waistband, ankle strap and foot strap.

20 Claims, 11 Drawing Sheets

U.S. PATENT DOCUMENTS 5,437,591 A 8/1995 Chen
5,486,149 A 1/1996 Smith
5,618,249 A 4/1997 Marshall
5,709,637 A 1/1998 Gow
5,733,231 A 3/1998 Corn
5,876,310 A 3/1999 Mackey
6,099,447 A 8/2000 Ramsaroop
6,149,559 A 11/2000 Mackey
6,283,899 B1 9/2001 Charnitski
6,315,701 B1 11/2001 Shifferaw

PORTABLE HANDHELD EXERCISE APPARATUS WHICH CAN BE ATTACHED TO A MULTIPLICITY OF BODY PARTS

BACKGROUND OF THE INVENTION

1. Field of the Invention

The present invention relates generally to the field of sport and exercise devices and more particularly relates to a portable personal training and exercise device which utilizes a cable and pulley mechanism.

2. Description of the Prior Art

In recent years personal training and exercise devices have become very popular. Many different types of personal training and exercise devices including fixed, stationary and portable exercise devices have been designed and introduced into the marketplace. The following prior art patents are representative of the types of exercise devices which are known in the prior art.

1. U.S. Pat. No. 766,748 issued to Terry on Aug. 2, 1904 for "Physical Exerciser And Developer" (hereafter the "Terry Patent");

2. U.S. Pat. No. 913,799 issued to Burguet on Mar. 2, 1909 for "Exercising Apparatus" (hereafter the "Burguet Patent");

3. U.S. Pat. No. 1,573,362 issued to Stovall on Feb. 16, 1926 for "Child's Toy And Exerciser" (hereafter the "Stovall Patent");

4. U.S. Pat. No. 3,841,627 issued to Vetter on Oct. 15, 1974 for "Push Pull Rotatable Wheel Type exercising Device" (hereafter the "Vetter Patent");

5. U.S. Pat. No. 3,885,789 issued to Deluty on May 27, 1975 for "Exercising Device" (hereafter the "Deluty Patent");

6. U.S. Pat. No. Des. 241,150 issued to Hale on Aug. 24, 1976 for "Physical Exerciser" (hereafter the "Hale Patent");

7. U.S. Pat. No. 4,174,832 issued to Thompson on Nov. 20, 1979 for "Friction Type Exercise Device" (hereafter the "Thompson Patent");

8. U.S. Pat. No. 4,328,965 issued to Hatfield on May 11, 1982 for "Portable Archery Muscle Developer" (hereafter the "Hatfield Patent");

9. U.S. Pat. No. Des. 304,748 issued to Bowers on Nov. 21, 1989 for "Hand Held Exerciser" (hereafter the "Bowers Patent");

10. U.S. Pat. No. 5,358,461 issued to Bailey, Jr. on Oct. 25, 1994 for "Exerciser Activated Body-Mounted Lights And Generators" (hereafter the "Bailey Patent");

11. U.S. Pat. No. 5,437,591 issued to Chen on Aug. 1, 1995 for "Chest Expander" (hereafter the "Chen Patent");

12. U.S. Pat. No. 5,486,149 issued to Smith on Jan. 23, 1996 for "Friction Resistance Exercise Device" (hereafter the "Smith Patent");

13. U.S. Pat. No. 5,618,249 issued to Marshall on Apr. 8, 1997 for "Unidirectionally Adjustably Resistant Recoilers And Portable Exercise Devices" (hereafter the "Marshall Patent");

14. U.S. Pat. No. 5,709,637 issued to Gow on Jan. 20, 1998 for "Rotator Cuff Strength Training Device" (hereafter the "Gow Patent");

15. U.S. Pat. No. 5,733,231 issued to Corn on Mar. 31, 1998 for "Exercise Device With Variable Resistance" (hereafter the "Corn Patent");

16. U.S. Pat. No. 5,876,310 issued to Mackey on Mar. 2, 1999 for "Upper Body Exercise Device" (hereafter the "'310 Mackey Patent");

17. U.S. Pat. No. 6,099,447 issued to Ramsaroop on Aug. 8, 2000 for "Exercise Belt" (hereafter the "Ramsaroop Patent");

18. U.S. Pat. No. 6,149,559 issued to Mackey on Nov. 21, 2000 for "Variable Resistance Exercise Device" (hereafter the "'559 Mackey Patent");

19. U.S. Pat. No. 6,283,899 B1 issued to Charnitski on Sep. 4, 2001 for "Inertial Resistance Exercise Apparatus And Method" (hereafter the "Charnitski Patent");

20. U.S. Pat. No. 6,315,701 issued to Shifferaw on Nov. 13, 2001 for "Portable Exercise Machine" (hereafter the "Shifferaw Patent");

In the Vetter Patent to surmount a resistance a flywheel mass and a pulling member are mounted at one end of a shaft which is journaled in a housing of a gymnastics apparatus. The pulling or drawing member includes a rope which can be wound or unwound from the shaft. The rope has one of its ends fixed to the shaft end while the other end of the rope is attached to the housing and the main portion of the rope is guided over guide rollers housed in an independent handle which is pulled by a user.

The Deluty Patent discloses an exercising device having a housing which is attached to a stationary surface. A cord with a hand grip on its free end can be pulled out of the housing against the internal resistance of the exercising device. The amount of internal resistance can be varied by means of a control knob. An automatic rewind mechanism draws the cord back into the housing when the cord is released. The device has, as a specific feature, a manually adjustable resisting force mechanism. This mechanism includes the combination of a stationary capstan around which the cord is wrapped, and a variable force friction nip mechanism which (a) retards the cord as it is pulled out of the housing, and (b) maximizes the capstan's frictional resistance by keeping the cord tightly wound around the capstan as the cord is being pulled out of the housing.

The Thompson Patent discloses an exercise device has a cord contained in a housing with a handle on the cord to pull it out of the housing. Resistance is developed by sliding friction between the cord and the housing and between the cord and a spool in the housing. The device has independent adjustment for controlling the friction between the cord and the housing and the spool friction. A recoil wheel retracts the cord.

The Hatfield Patent discloses a compact, portable archery exerciser allows an archer to accurately emulate the pulling of a bow to tone and strengthen the muscles used in archery. A first embodiment of the exerciser comprises two elongated handle members which are interconnected at the ends by a selectable number of resilient members to provide an exerciser with a selectable pull weight. A second embodiment of the exerciser includes a housing having an internal chamber and a handle portion for receiving an archer's bow holding hand. A spring loaded pulley is mounted within the chamber and receives a cable which, when unwound from the pulley, compresses the spring. The cable is routed outside the chamber where it is attached to a handle which is positioned to allow an operator of the exerciser to pull the handle away from the handle portion of the housing to accurately simulate the pulling of a bow. An adjustable pulley mounted within the chamber engages the cable to allow adjustment of the pull weight of the second embodiment of the exerciser.

The Bailey Patent discloses exercise activated body-mounted lights and generators wherein generators attached to bright lights on exercise clothing are turned by recoiling pull-cords attached to hand grips pulled during the normal arm movement of the exercise to light the path of the exerciser. Bright white front lights may pivot to adust for the body angle of the exerciser. Colored back lights may also be lighted to make the exerciser more visible from the rear. A vest or belt and shoulder straps both attached adjustably by VELCRO (hooks and loops fastener) are used to support the generators and lights on the body of the exerciser. Wires run under the material of the belt or vest to the lights. Alternately, a single generator in the center of the back with two separate cord reels, on at each side, may be used to turn the generator. The generators and reels are covered by waterproof material. A one-way drive in the cord reel turns the generator only in one direction to create power. Weights may be added to the hand grips to enhance the exercise effect of moving the arms. An alternate grip in the shape of a ski-pole grip is attached to a ski pole for cross-country skiing at night. The system could be supplemented with a battery to store electricity so that the lights may remain on during rest periods. The invention is used for night-time jogging, walking, roller blading, cross-country skiing, or other activities where it is desired to light the path of the exerciser and make the exerciser visible from the rear.

The Chen Patent discloses a chest expander includes a first handle having two distal ends, a substantially U-shaped tubular housing including a first line and a second line extended from two limb ends thereof and connected to two distal ends of the first handle, a second handle connected between the two limbs of the U-shaped tubular housing, and a load adjusting mechanism being received in one corner of the U-shaped tubular housing allowing a user to adjust the load of the chest expander. The two handles of the chest expander are manually extended and retracted repeatedly via the two lines.

The Smith Patent discloses a one-way clutch which is rotatable with a member (e.g. helical spring) and a sleeve, while the spring is being constrained by the manual winding of a cable on the sleeve. The sleeve is constructed to wind the cable uniformly on the sleeve. During the constraint imposition, the clutch drives a shaft and a disc. One disc surface abuts bearing liners affixed to a casing. The other disc surface is separated from the spring. Calibrated numbers are printed on the casing periphery. A dial externally supported by the casing is rotatable relative to the casing to any of the calibrated numbers to adjust the friction force between the liners and the disc when the disc is rotated. The casing is vented at its opposite ends. When the spring is being constrained or the constraint is being released, air flows through the vents and through the space between the successive turns in the spring and past the disc to cool the disc. When the spring constraint is released, the clutch floats relative to the shaft so that the spring returns to its unconstrained relationship without any movement of the shaft or the disc. The dial is also adjustable in position, independently of any dial rotation, after being removed from the casing to adjust the calibration of the friction force between the liner and the disc and is thereafter attached to the casing in this adjusted position. Another looped cable anchors the exercise apparatus against a post before the apparatus is operated.

The Marshall Patent discloses an upper body exercise device comprising a base (10) on which two adjustably resistant recoilers (20) are mounted is contained in a waist pouch (30). Two extension members (40) extend outwardly and downwardly from the base (10) and pulleys (50) are attached to the recoilers (20) are threaded through the pulleys (50) and handles (70) are provided at the ends. The extension members (40) displace and direct frictional force created by the recoilers (20), and the pouch (30) makes the device easy to put on and take off. The recoilers (20) preferably provide adjustably resistant force against tension applied to the cords (60) and a slight restoring force sufficient to recoil the cords (600 when tension is released. This avoids safety problems with other mechanisms that provide a restoring force equal to the displacing force.

The Gow Patent discloses a portable exercise device which is provided for specific strength training of the rotator cuff. A cylindrical spool member is provided with a handle across its diameter. A length of rubber exercise tubing is fixed tangentially to one point of the spool, with the other end attachable to a fixed point on an inertial resistance, allowing the user to grip the handle and rotate or move the spool against a continuous resistance for muscle development.

The Corn Patent discloses an exercise apparatus includes a plurality of inelastic, retractable cords, each terminating at a handgrip. A retracting mechanism is provided for retracting the cords. Separate resistance mechanisms are provided to resist each of the cords as the cords are being withdrawn from the retracting mechanism. The resistance mechanisms operate independently of one another. At least one removable disk unit is connectable to the resistance mechanism of the exercise apparatus for incrementally increasing resistance force with respect to unwinding movement of the cords when operably connected to the resistance mechanism. The removable disk units can be preloaded with a predetermined biasing resistance force when assembled during manufacturing, and the biasing resistance force can be maintained while not connected to the main unit of the exercise apparatus. The preload maintenance mechanism maintains the preloaded spring force of the removable disk unit while connected to the main unit, as well as when disconnected from the main unit.

The '310 Mackey Patent discloses an upper body exercise device designed to be used by a person while walking. The device consists of a belt to which a pair of cables is attached. The cables are retractable and roll up automatically, via a spring reel assembly, onto spools located within a pair of handgrips. The user grasps the handgrips and pulls outwardly while walking. The force required to pull the handgrips outwardly can be increased or decreased by turning an adjustment knob located on the outside of each handgrip. The adjustment knob causes a frictional force to be exerted on the cable spool making it easier or harder to pull the cable out. Straps are provided on each side of the belt to store the handgrips when not in use. Obviously the device of the present invention may also be used while in stationary position or while jogging.

The Ramsaroop Patent discloses an exercise belt for exercising the upper body of a user. The exercise belt includes a belt and a pair of cable retracting devices coupled to the belt. Each of the cable retracting devices comprises a housing and a cable that is retractably extended from the housing. A pair of handles are coupled to free ends of the cables.

The Mackey '559 patent discloses a variable resistance exercise device with a resistance mechanism comprised of a housing, spring reel, extension cable and resistance applying knob. A strap helps attach the resistance mechanism to a person's arm or keg. An eye bolt or bracket is attached to a wall. A retaining clip attaches to the wall bracket at the end of the cable of the resistance mechanism. An alternate embodiment where the resistance mechanism is removably attached to a wall at one end and a user retaining or holding means attached to said cable at the opposite end. A preferred embodiment includes wherein said housing has a padded portion on its underside where it interfaces the users arm or leg.

The Charnitski Patent discloses an exercise apparatus and method which utilizes a flywheel mounted on a rotatable axle. The user exercises by accelerating and decelerating the rotation of the flywheel. For example, a line which wraps around the axle provides a mechanism for accelerating and decelerating the flywheel when a user applies a pulling force to the line. The inertia of the flywheel resists the user applied pulling force and provides the exercise mechanism. Preferably, spool mounted on the axle and variable pivot locations provide a mechanism for easily varying the exercise resistance.

The Shifferaw Patent discloses a portable exercise machine having a base, a capstan rotatively mounted within the base, an elongated cable wrapped about the capstan and trained about guides toward opposite ends of the base with end portions of the cable extending beyond the base, handles attached to the end portions of the cable for drawing the cable back and forth through the base and thereby rotating the capstan, and means for resisting rotation of the capstan. The handles have frames with reels rotatively mounted on the frames and the end portions of the cable being wound about the reels, springs for rotating the reels to wind the end portions of the cable onto the reels, first grips connected to the reels and adapted to be grasped by the hands of an exerciser to prevent rotation of the reels and second grips connected to the frames and adapted to be engaged by the hands of the exerciser for moving thee handles without inhibiting rotation of the reels.

In spite of the numerous types of exercise devices in the prior art, none of these devices are portable, can have varied resistance and are capable of attachment to numerous body parts to facilitate a wide range of exercises. There is a significant need for such a device. It is also desirable to provide a new design and construction of a portable personal exercise device that utilizes the above features.

SUMMARY OF THE INVENTION

The present invention is directed to a portable personal training and exercise device with a cable and pulley mechanism which also is a mobile personal training and exercise device having an ergonomic plastic external housing that with the use of straps fits in the hand as well as against different parts of the body.

It is an object of the present invention to provide a multipurpose lightweight exercise device that is in the shape of a small rounded box that fits in the hand with a pulley and braking apparatus inside.

It is a further object of the present invention to provide a multipurpose portable exercise device that can fit onto the ankles and other body parts to provide a multiplicity of different types of exercises.

It is an additional object of the present invention to provide an exercise device wherein the resistance level for the cord or cable can be adjusted independently and modular units can be used in a freestanding style or attached onto various accessory extensions and specific equipment.

It is another object of the present invention to provide an exercise device that enables a person to perform all types of three dimensional movement with resistance. Consequently, it is easy to combine movements and customize workouts according to personal goals and levels of fitness.

It is a further object of the present invention to provide a portable exercise device which can be used while standing, sitting in various orientations, and also used while walking to engage the upper body for intensification of an aerobic workout.

In a preferred embodiment of the present invention, the device of the present invention comprises a cable and pulley mechanism inside a housing which has a pulley rotatably mounted on a shaft that spins in only one direction. The pulley spins in both directions so that it is spring biased for rewinding a cord or cable onto the pulley. Next to the pulley is a brake wheel that is attached to the shaft. The brake wheel and a pulley spinning on a single shaft inserts into a sealed ball bearing on both ends. A spring is connected to the bottom of the pulley. In the center of the pulley is a combination ball bearing/one-way clutch that turns the shaft only in one direction. The shaft is attached to the brake wheel. Secured around the outer edge of the brake wheel is a brake band. The brake band can be tightened for variable resistance through a tension adjustment assembly comprised of a tension bolt, threaded block, coil spring and adjustment housing. There is also a multi-directional guide unit mounted on the housing for allowing the pulley cords or cables to be pulled in multiple directions with variable amounts of friction. The cord or cable, which is wrapped around the pulley, emerges through a multi-directional bearing that rotates 360 degrees, thus allowing full range of three dimensional motion. Therefore, a user may pull the cords or cables of the pulley for exercising various muscles of the user and adjust the resistance force of the cord or cable at an appropriate level from the user. Different attachments can be connected to the snap at the end of the cord or cable such as a grip handle, wrist strap, waistband, ankle strap and foot strap.

In an alternative embodiment of the present invention, the device of the present invention comprises a cable and pulley mechanism inside a housing which has a pulley rotatably mounted on a shaft that spins in only one direction. The pulley spins in both directions so that it is spring biased for rewinding a cord or cable onto the pulley. Next to the pulley is a brake bushing that is attached to the shaft. The brake bushing and a pulley spinning on a single shaft inserts into a sealed ball bearing on both ends. A spring is connected to the bottom of the pulley. In the center of the pulley is a combination ball bearing/one-way clutch that turns the shaft only in one direction. The shaft is attached to the brake bushing. Secured around the outer edge of the brake bushing is a brake clamp. The brake clamp can be tightened for variable resistance through a tension adjustment assembly comprised of a tension bolt, coil spring and adjustment knob. There is also a multi-directional guide unit mounted on the housing for allowing the pulley cords or cables to be pulled in multiple directions with variable amounts of friction. The cord or cable, which is wrapped around the pulley, emerges through a multi-directional bearing that rotates 360 degrees, thus allowing full range of three dimensional motion. Therefore, a user may pull the cords or cables of the pulley for exercising various muscles of the user and adjust the resistance force of the cord or cable at an appropriate level from the user. Different attachments can be connected to the snap at the end of the cord or cable such as a grip handle, wrist strap, waistband, ankle strap and foot strap.

The present invention has many novel and unique features and advantages. It provides a new design and construction of a portable personal exercise device that offers a wide range of exercise options with a high degree of variation in resistance provided to its user. It also provides a new design and construction of a portable personal exercise device that utilizes a cable and pulley mechanism which is easy to operate and is also easy to maintain. It further provides a new design and construction of a portable personal exercise device that is light in weight, compact in size, and low in cost.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
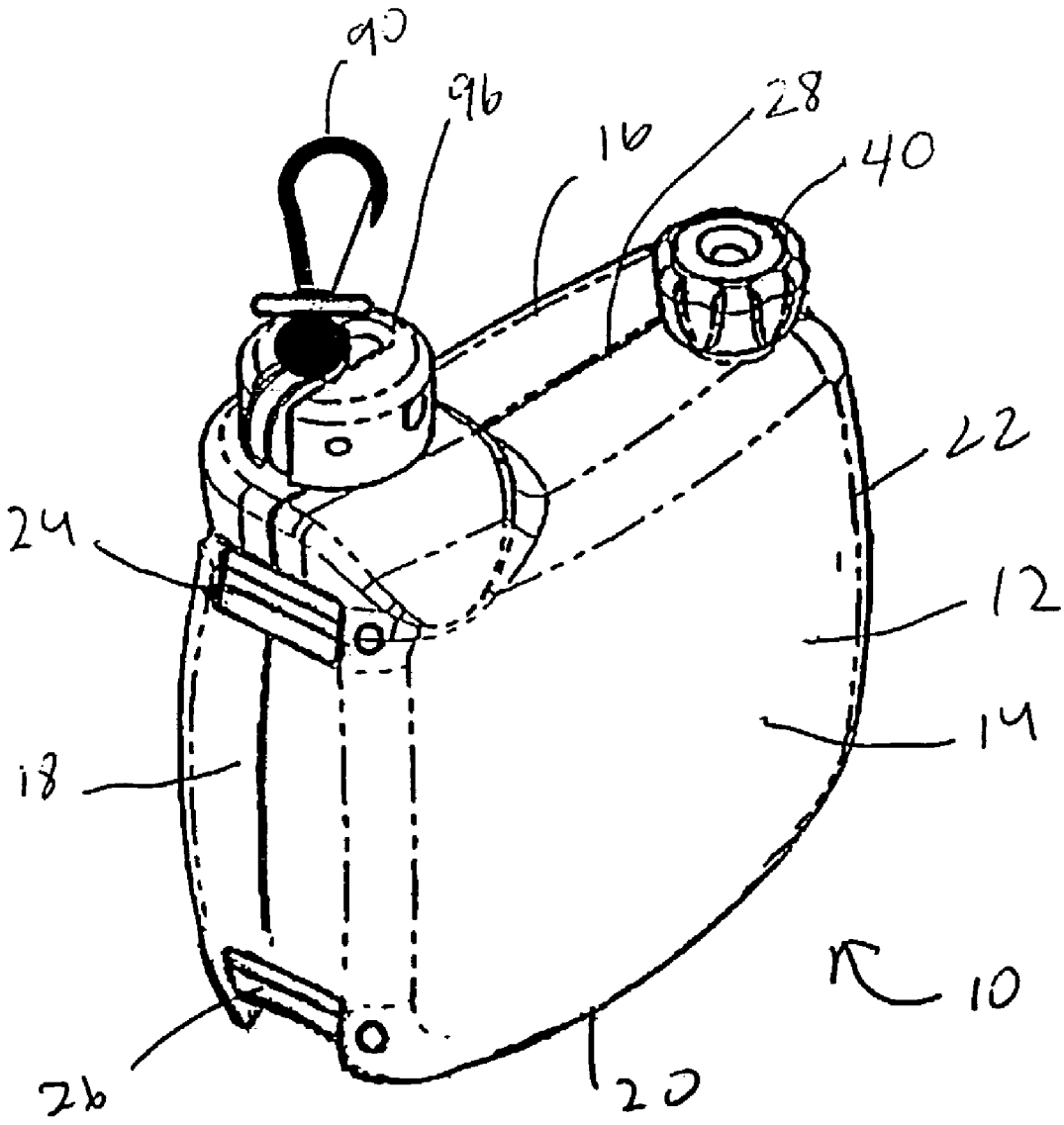
FIG. 1 is a perspective view of the exterior of the present invention exercise device, with the cable in its retracted position.
Figure 2:
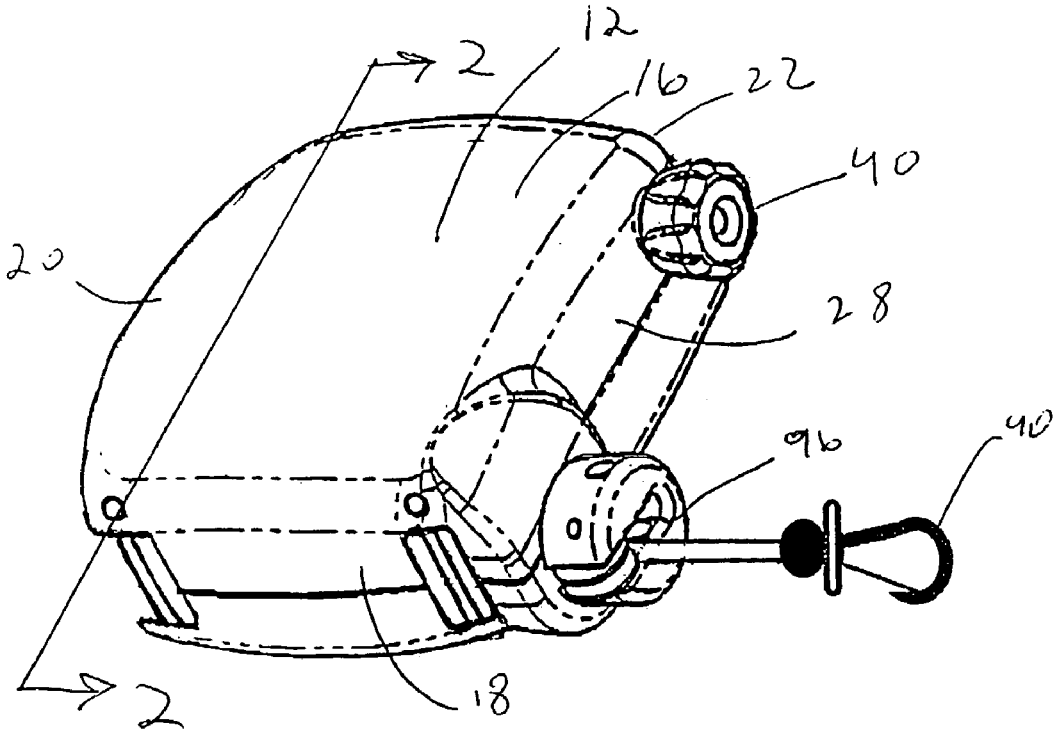
FIG. 2 is a perspective view of the exterior of the present invention exercise device, with the cable partially extended.

Referring to FIGS. 1 and 2, the present invention exercise device 10 comprises an outer shell or casing 12 having a first half 14 connected to a second half 16. Strap attachment means are located along first side edge 18 and second side edge 22, two of which 24 and 26, are illustrated on first side edge 18. Extending from the top 28 is a tension knob 40 adjacent second side edge 22 and a redirection swivel 96 adjacent first side edge 8. The exercise device 10 also has a bottom edge 20.

Figure 3:
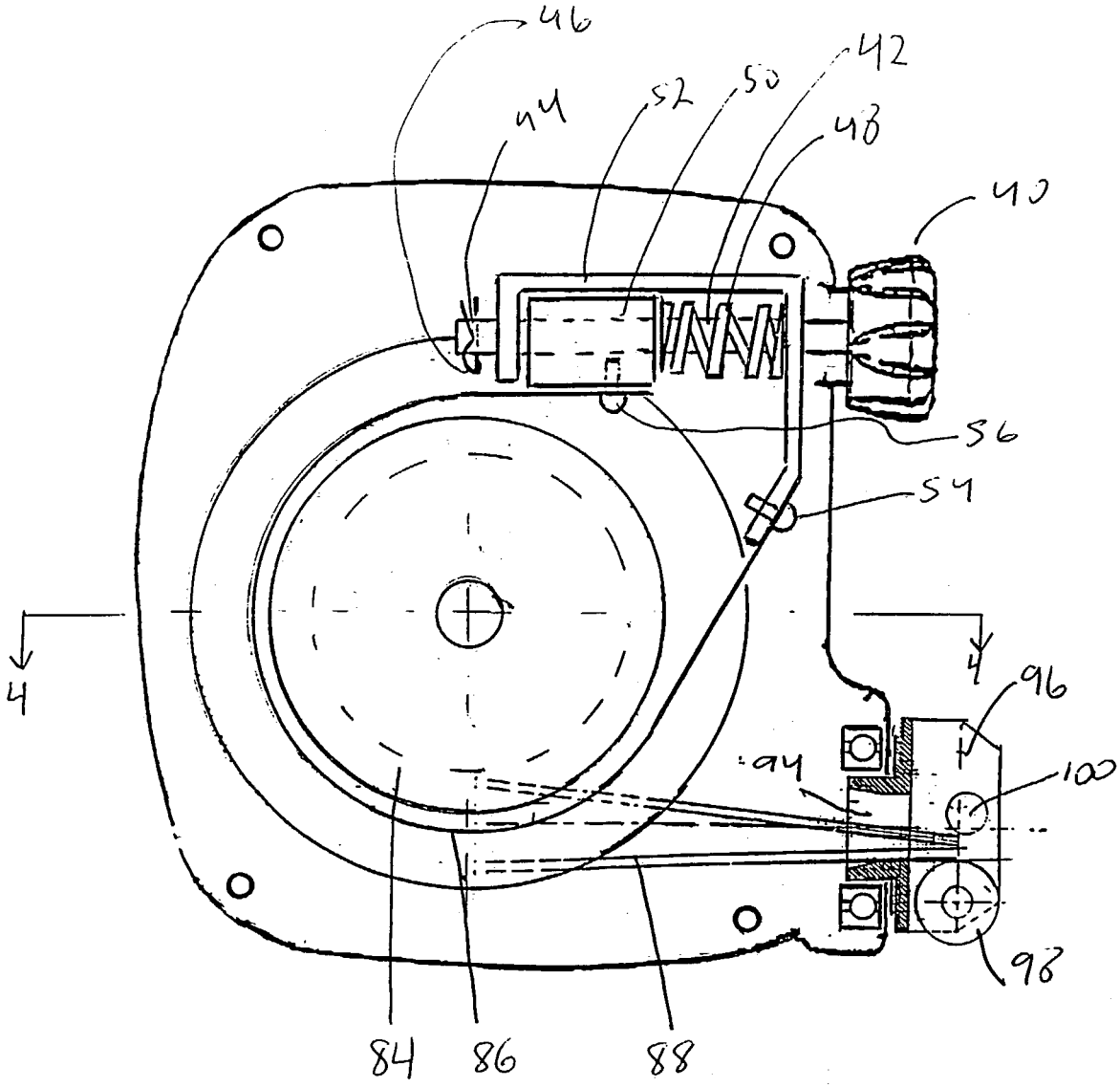
FIG. 3 is a partial cross-sectional view taken along line 3—3 of FIG. 2.
Figure 5:
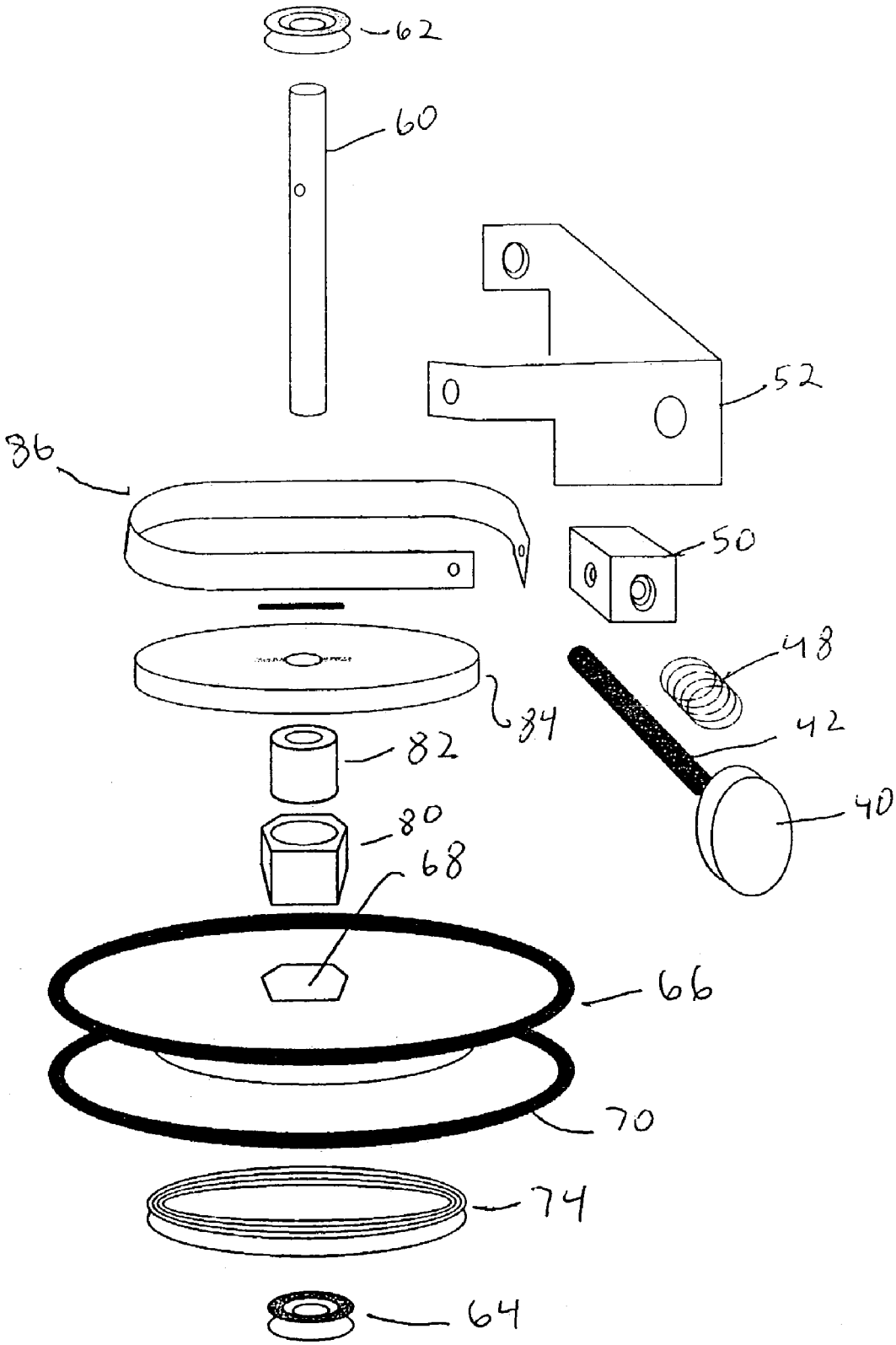
FIG. 5 is an exploded view showing the internal components of the exercise device.

Referring to FIGS. 3 and 5, tension knob 40 is attached to a tension bolt 42, which bolt has an opening 44 at the bolt's opposite end through which a cotter pin 46 is inserted. A tension coil spring 48 surrounds the tension bolt 42 along its upper half closer to the tension knob 40 and a tension adjustment block 50 surrounds the tension bolt 42 along its lower half closer to the cotter pin 46. A tension bolt support adjustment housing 52 supports the tension bolt 42 and its associated tension coil spring 48 and tension block within exercise device 10.

Figure 4:
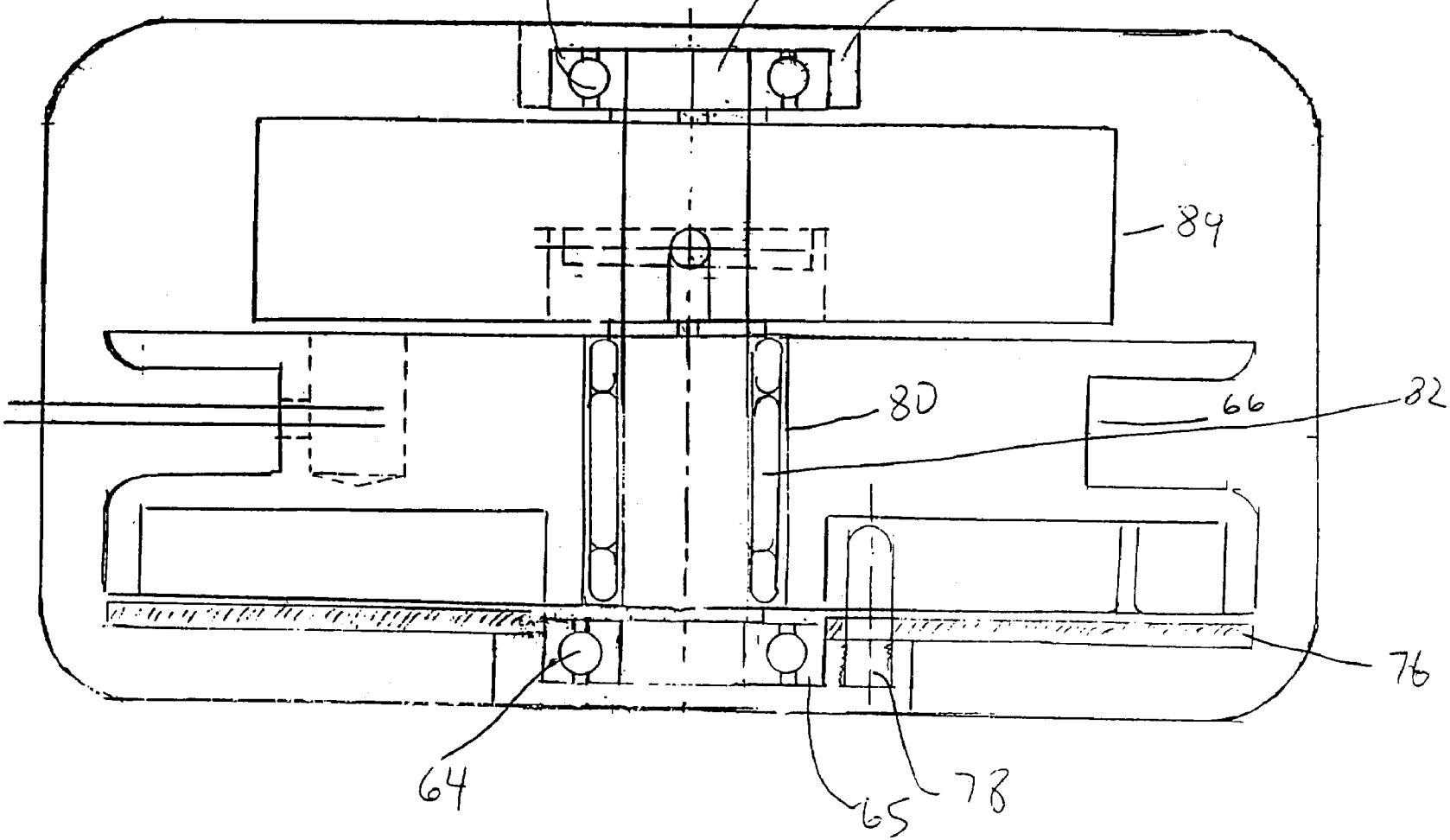
FIG. 4 is a cross-sectional view taken along line 4—4 of FIG. 3.

Referring to FIGS. 3 through 5, the pulley and braking system is illustrated. A pulley shaft 60 has a first sealed bearing 62 at its upper end and a second sealed bearing 64 at its lower end. First sealed bearing 62 is housed in a first sealed bearing holder 63 and second sealed bearing 64 is housed in a second sealed bearing holder 65. Rotatably mounted on the pulley shaft 60 is a pulley 66 having a central opening 68 through which a clutch retainer 80 is inserted. Adjacent the lower rim 70 of pulley 66 is a return clock spring 74 supported on a spring retainer plate 76. The clock spring 76 is wound on a spring pin 78 which extends through the spring retainer plate 76. The clock spring 74 is attached onto the lower rim 70 of pulley 66 to provide return rotational motion to the pulley 66. A clutch retainer 80 is positioned into the opening 68 in the pulley 66. The clutch retainer 80 supports and retains a combination ball bearing one-way clutch 82 which is also supported on pulley shaft 60.

Positioned above the pulley 60 and above the combination ball bearing one-way clutch 82 is a brake wheel 84. Surrounding brake wheel 84 is a brake band 86. The brake band 86 is attached at one end to the tension bolt support adjustment housing 52 by a first brake pan 54. The brake band 86 is attached at its opposite end to the tension adjustment block 50 by a second brake pin 56. As the tension knob 40 is rotated in the clockwise direction, it causes the brake band 86 to wrap more tightly around the brake wheel 84 to provide more resistance to the pulley 66. The rotation of the tension knob 40 causes the tension bolt support housing 52 and the tension adjustment block 50 to cause the brake band 86 to wrap more tightly around brake wheel 84 to provide greater resistance. When the tension adjustment knob 40 is wound in the other direction, the resistance is decreased.

Wrapped around pulley 60 is a cable 88 which extends through opening 94 in the top 28 and extends through redirection swivel 96. Cable 88 has a snap fastener 90 at its open end, which snap fastener 90 includes a ball 92 to prevent the open end of the cord from going into the housing. The cable 88 passes between a redirection pulley 98 and a swivel pin 100, both within the redirection swivel 96.

The pulley 66 rotates on shaft 60 by means of the ball bearings 62 and 64 and combination ball bearing one-way clutch 82. The pulley 66 spins on shaft 60 which shaft 60 is inserted into sealed ball bearings 62 and 64 located at opposite ends of the shaft. The spring 74 is connected to the bottom of the pulley 66 as previously described. In the center of the pulley 66 is the combination ball bearing one-way clutch 82 that turns the shaft 60 only in one direction. The shaft 60 is attached to the brake wheel 84 and secured around the outer edge of the brake wheel is a brake band 86. The brake band 86 can be tightened for variable resistance through an adjustment assembly comprised of a tension bolt 42, threaded tension adjustment block 50, coil spring 48 and adjustment housing 52. Therefore, beside the brake assembly is the tension adjustment unit for adjusting the tension of the pulley 66 from the brake band 86 around the brake wheel 84.

The cable 88, which is wrapped around the pulley 66, emerges through a multi-direction bearing or swivel 96 that rotates 360 degrees, thus allowing a full range of three dimensional motion with variable amounts of friction.

A user may pull on the cable 88 of the pulley 66 for exercising various muscles of the user and adjust the resistance force of the cable 88 at an appropriate level for the user. The resistance level can be adjusted independently and modular units can be used in a free standing style or attached onto various accessory extensions and specific equipment.

Figure 3A:
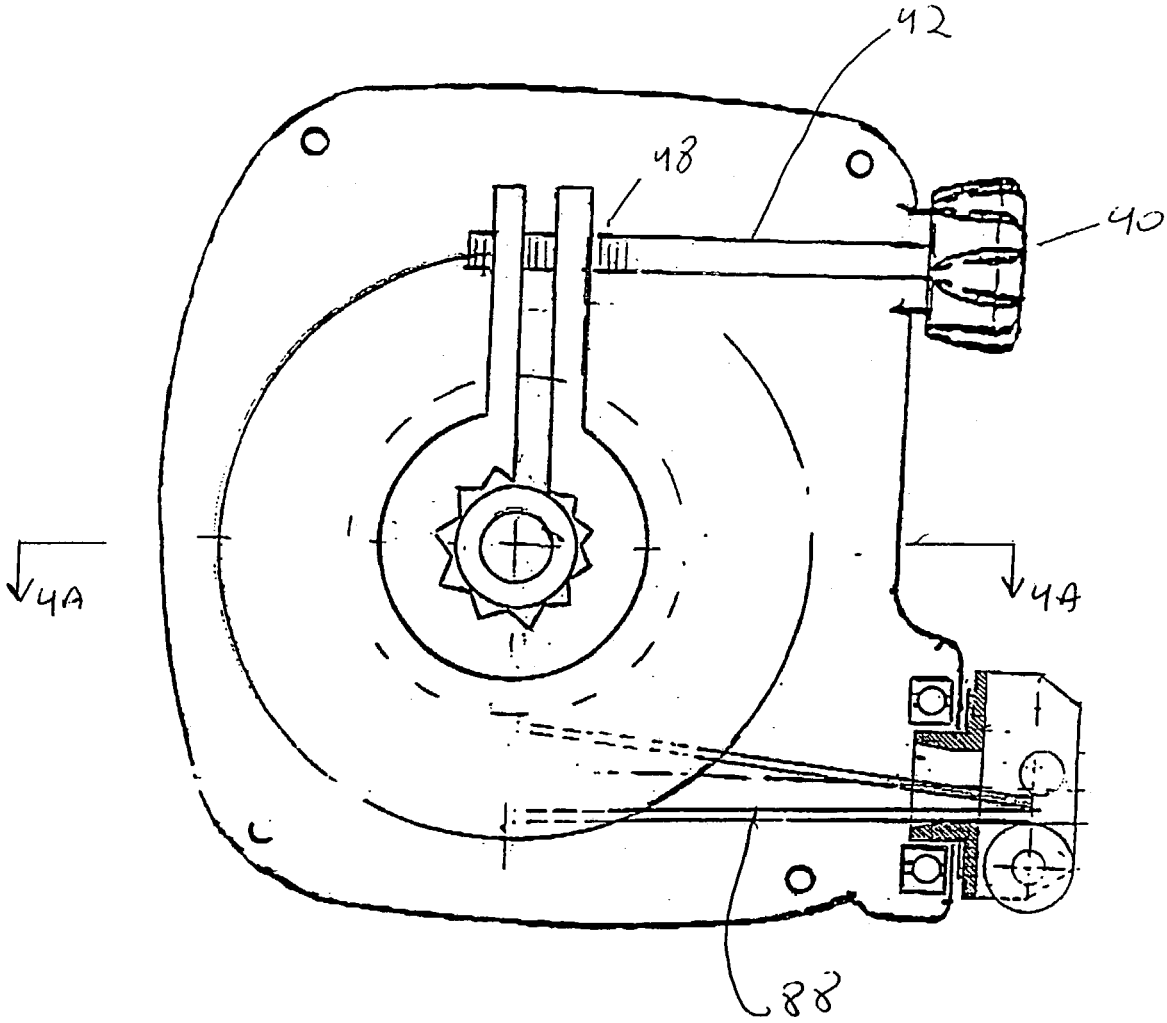
FIG. 3A is a partial cross-sectional view of an alternative braking system for the present invention.
Figure 5A:
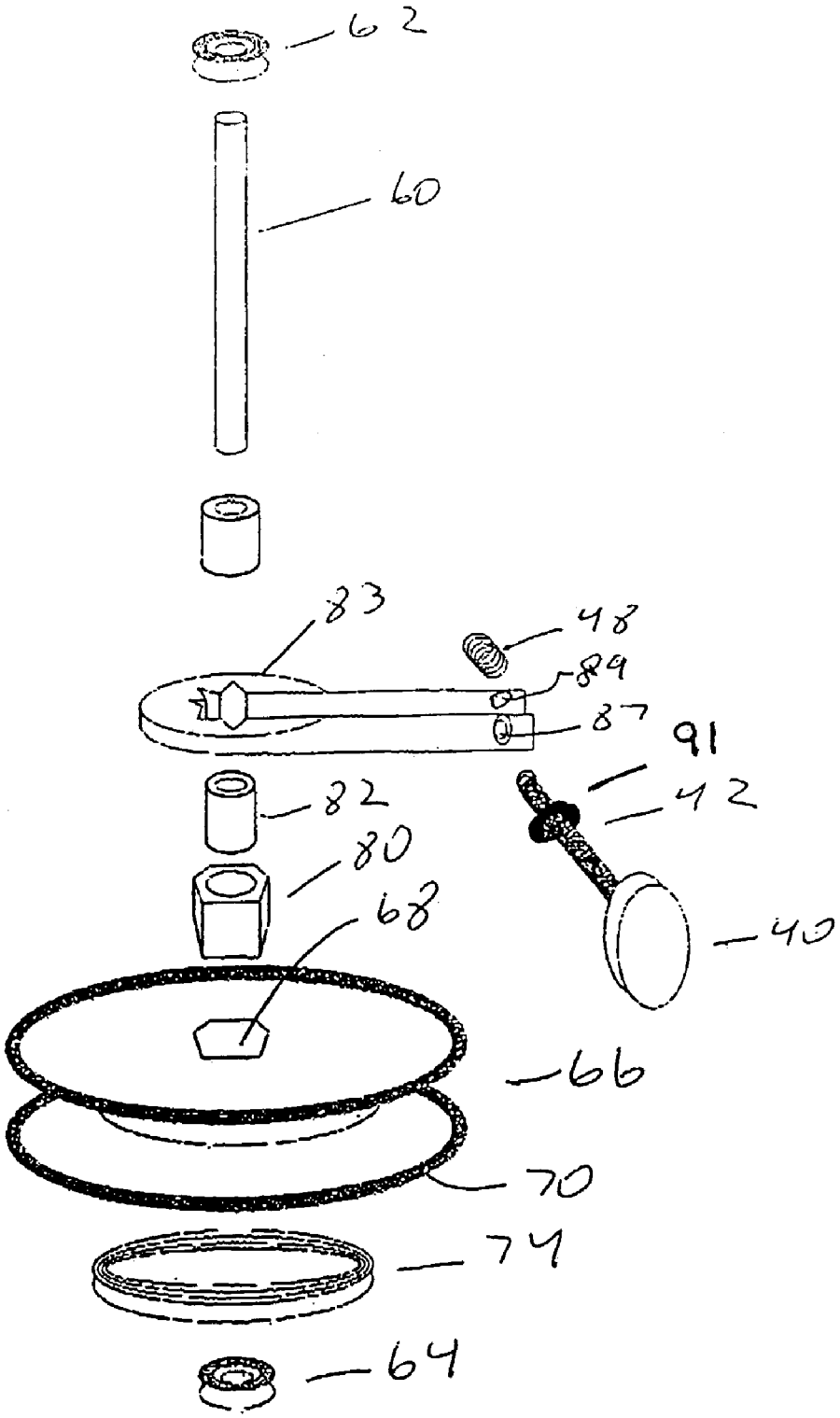
FIG. 5A is an exploded view showing the internal components of the exercise device with the alternative braking system.
Figure 6:
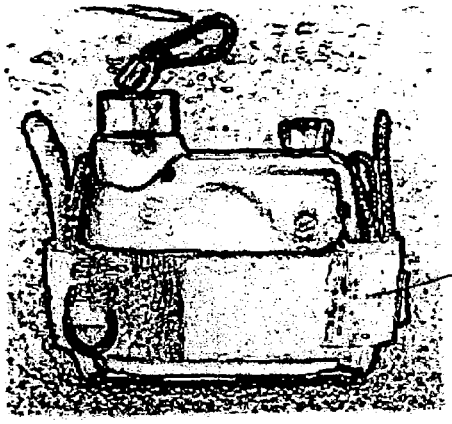
FIG. 6 is a perspective view of the exercise device with a strap attached to the exercise device.

In an alternative variation of the present invention, the braking system is modified to a simpler and more efficient design. The parts eliminated in this alternative embodiment are the brake wheel 84, the brake band 86, the tension bolt support adjustment housing 52 and the tension adjustment block 50. Substituted for these parts is a brake bushing 83 and a brake clamp 85. The brake wheel 84 is replaced with the brake bushing 83. The brake band 86 is replaced with a brake clamp 85. The brake bushing 83 fits over the pulley shaft 60 on top of the pulley 66 and the brake clamp 85 fits around the brake bushing 83. The brake clamp 85 has openings 87 and 89 adjacent its respective ends. The tension bolt 42 has a tension knob 40 at one end and a tension coil spring 48 which fits on the tension bolt 42 at the location of the brake clamp 85 and through its openings 87 and 89 as illustrated in FIGS. 3A and 5A. As the knob 40 is turned in the clockwise direction, the tension bolt 42 tightens the ends of the brake clamp 85, thus squeezing the brake bushing 83 and applying resistance pressure to the pulley shaft 60 when it is turned by the combination ball bearing one-way clutch 82 in the center of the pulley 66.

Referring to FIGS. 3A and 5A, tension knob 40 is attached to a tension bolt 42. A tension coil spring 48 surrounds the tension bolt 42 along its lower portion away from the tension knob 40.

Figure 4A:
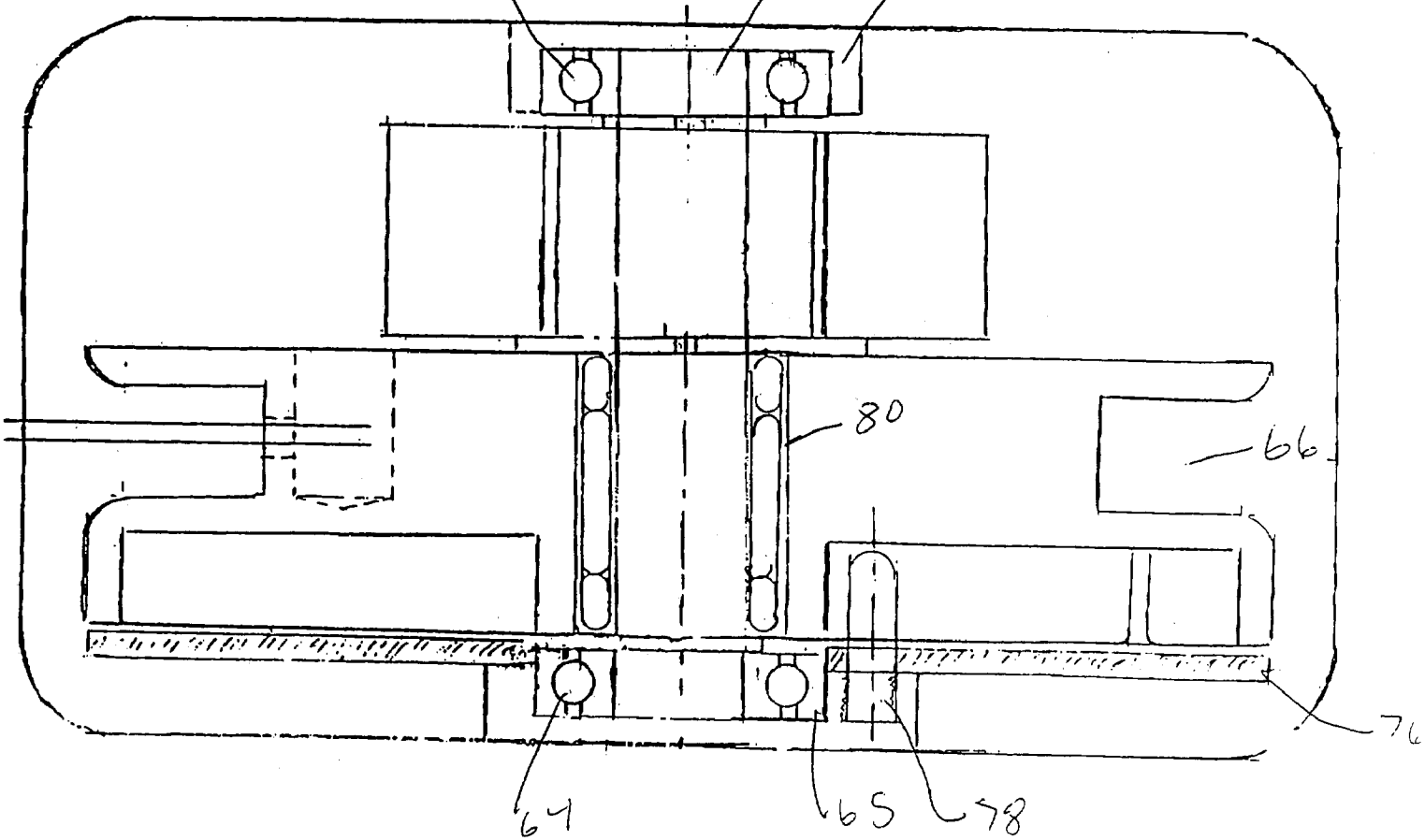
FIG. 4A is a cross-sectional view taken a long Line 4A—4A of FIG. 3A.

Referring to FIGS. 3A, 4A and 5A, the alternative embodiment of the pulley and braking system is illustrated. A pulley shaft 60 has a first sealed bearing 62 at its upper end and a second sealed bearing 64 at its lower end. First sealed bearing 62 is housed in a first sealed bearing holder 63 and second sealed bearing 64 is housed in a second sealed bearing 65. Rotatably mounted on the pulley shaft 60 is a pulley 66 having a central opening 68 through which a clutch retainer 80 is inserted. Adjacent the lower rim 70 of pulley 66 is a return clock spring 74 supported on a spring retainer plate 76. The clock spring 76 is wound on a spring pin 78 which extends through the spring retainer plate 76. The clock spring 74 is attached onto the lower rim 70 of pulley 66 to provide return rotational motion to the pulley 66. A clutch retainer 80 is positioned into the opening 68 in the pulley 66. The clutch retainer 80 supports and retains a combination ball bearing one-way clutch 82 which is also supported on pulley shaft 60.

Positioned above the pulley 60 and above the combination ball bearing one-way clutch 82 is a brake bushing 83. Surrounding brake bushing 83 is a brake clamp 85. The brake bushing 83 fits over the pulley shaft 60 on top of the pulley 66 and the brake clamp 85 fits around the brake bushing 83. The brake clamp 85 has openings 87 and 89 adjacent its respective ends. The tension bolt 42 has a tension knob 40 at one end and a tension coil spring 48 which fits around the tension bolt 42 at the location of the brake clamp 85 and fits between its openings 87 and 89 as illustrated in FIGS. 3A and 5A. The tension bolt 42 is threaded at its end and is threaded into a threaded opening 89 in the brake clamp. A stopper 91 is located on the tension bolt adjacent opening 87. As the knob 40 is turned in the clockwise direction, the tension bolt 42 tightens the ends of the brake clamp 85, thus squeezing the brake bushing 83 and applying resistance pressure to the pulley shaft 60 when it is turned by the combination ball bearing one-way clutch 82 in the center of the pulley 66. When the tension adjustment knob 40 is wound in the other direction, the resistance is decreased as the spring opens the ends of the brake clamp.

Wrapped around pulley 60 is a cable 88 which extends through opening 94 in the top 28 and extends through redirection swivel 96. Cable 88 has a snap fastener 90 at its open end, which snap fastener 90 includes a ball 92 to prevent the open end of the cord from going into the housing. The cable 88 passes between a redirection pulley 98 and a swivel pin 100, both within the redirection swivel 96.

The pulley 66 rotates on shaft 60 by means of the ball bearings 62 and 64 and combination ball bearing one-way clutch 82. The pulley 66 spins on shaft 60 which shaft 60 is inserted into sealed ball bearings 62 and 64 located at opposite ends of the shaft. The spring 74 is connected to the bottom of the pulley 66 as previously described. In the center of the pulley 66 is the combination ball bearing one-way clutch 82 that turns the shaft 60 only in one direction. The shaft 60 is attached to the brake bushing 83 and secured around the outer edge of the brake bushing 83 is a brake clamp 85. The brake clamp 85 can be tightened for variable resistance through an adjustment assembly comprised of a tension bolt 42, coil spring 48 and tension knob 40. Therefore, beside the brake assembly is the tension adjustment unit for adjusting the tension of the pulley 66 from the brake clamp 85 around the brake bushing 83.

The cable 88, which is wrapped around the pulley 66, emerges through a multi-direction bearing or swivel 96 that rotates 360 degrees, thus allowing a full range of three dimensional motion with variable amounts of friction.

A user may pull on the cable 88 of the pulley 66 for exercising various muscles of the user and adjust the resistance force of the cable 88 at an appropriate level for the user. The resistance level can be adjusted independently and modular units can be used in a free standing style or attached onto various accessory extensions and specific equipment.

Referring to FIGS. 6 through 10, an adjustable strap 30 is affixed to the device 10 by means of the strap attachment means. The strap 30 is threaded through the strap attachment means. It is affixed to the outer shell 12 at one end and the strap can have mating fasteners on the other end which will mate with a fastener means on the strap, by way of example, hook and loop fasteners or mating strap fasteners, so the tightness of the strap can be adjusted.

Figure 7:
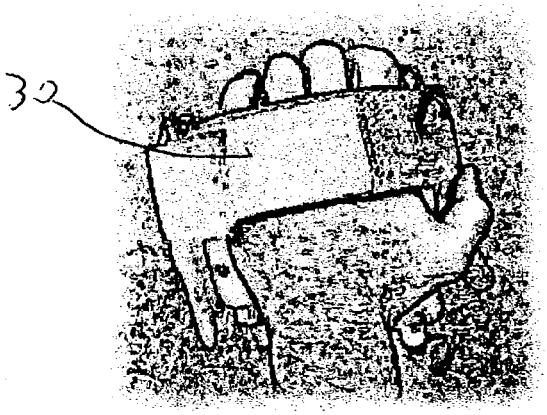
FIG. 7 is a perspective view demonstrating the exercise device held in a left hand with the strap fastened around the hand.
Figure 8:
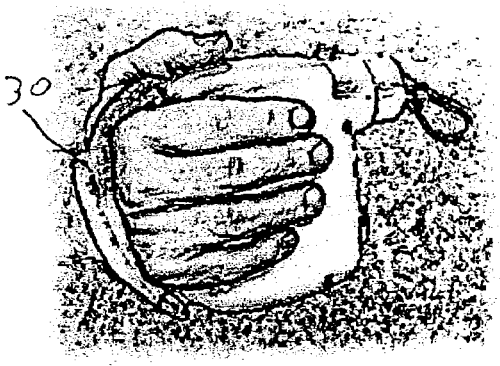
FIG. 8 is a perspective view demonstrating the exercise device in a right hand with the strap fastened around the hand.
Figure 9:
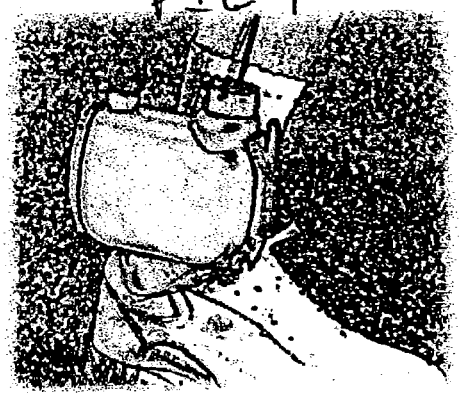
FIG. 9 is a perspective view demonstrating the exercise device attached to a user's leg by means of the strap.
Figure 10:
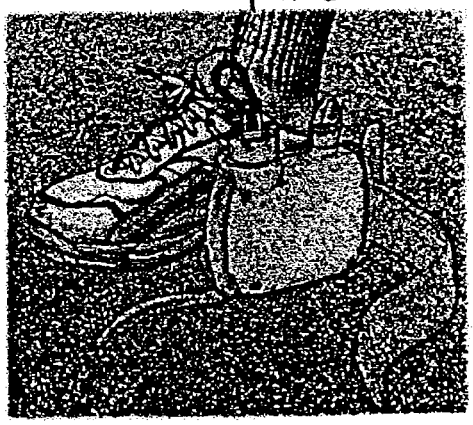
FIG. 10 is a perspective view showing the exercise device with the strap in the opened condition before being attached to a leg.
Figure 12:
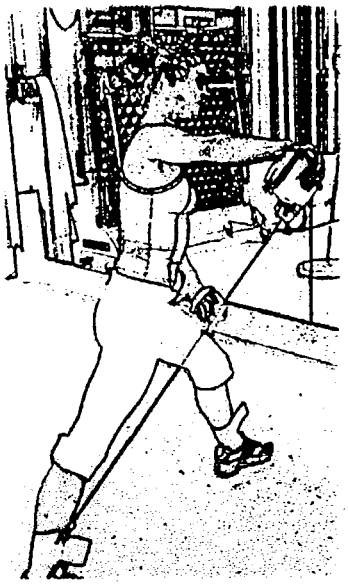
FIG. 12 is an illustrative view of an exercise being performed with the exercise device held in the user's hand and attached to a strap around a user's leg.
Figure 13:
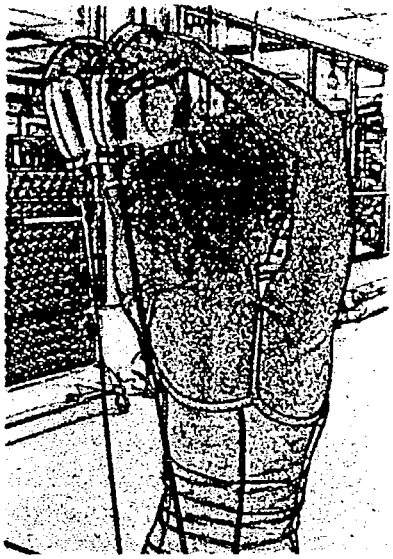
FIG. 13 is an illustrative view of another exercise being performed with the exercise device held in the user's hand and attached to a strap around a user's leg.
Figure 14:
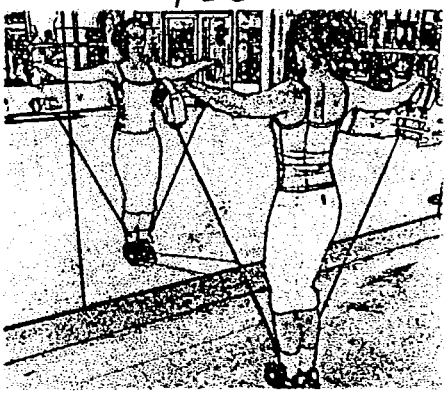
FIG. 14 is an illustrative view of an exercise being performed with two exercise devices, with each device held in a user's hand and respectively attached to a strap around each leg.
Figure 15:
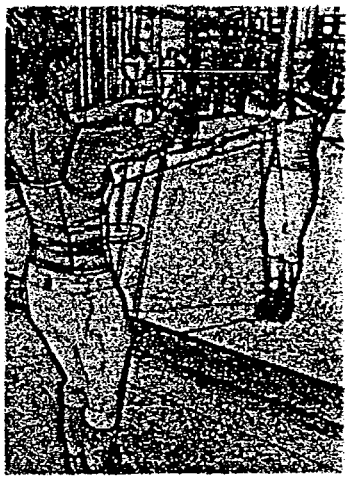
FIG. 15 is an illustrative view of another exercise being performed with two exercise devices, with each device held in a user's hand and respectively attached to a strap around each leg.
Figure 16:
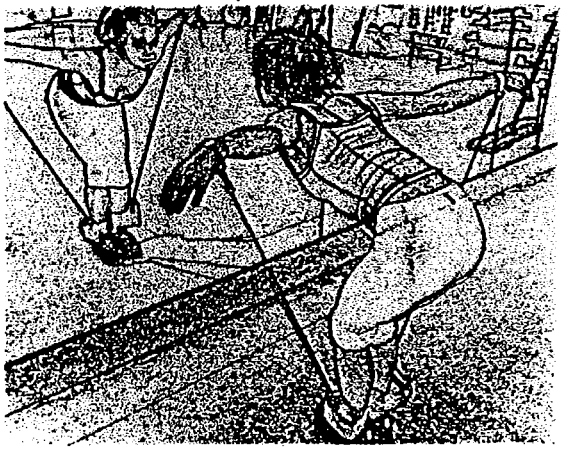
FIG. 16 is an illustrative view of yet another exercise being performed with two exercise devices, with an exercise device attached around each leg and the cord attached to a wrist strap.

As illustrated in FIGS. 7 and 8, the exercise device 10 can be held in one hand with the palm of the hand against the device 10 and then the strap 30 can be tightened against the back of the hand. As illustrated in FIGS. 9 and 10, the exercise device 10 can also be wrapped around a leg at the location of an ankle with the strap 30 tightened around the leg or ankle.

Figure 11:
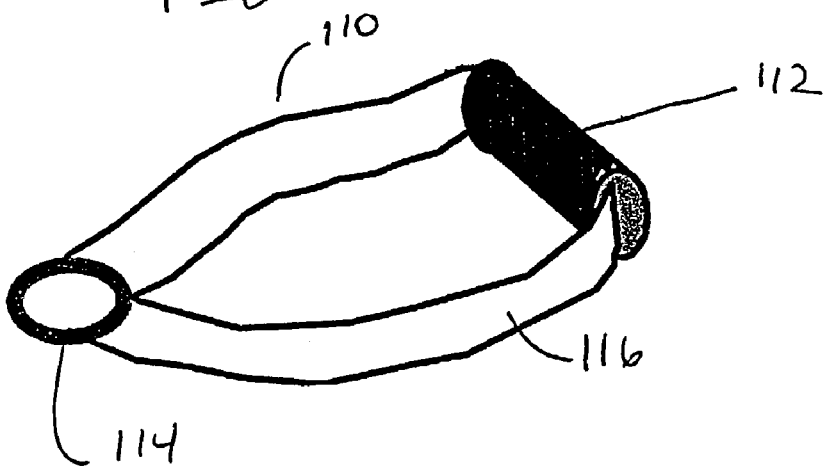
FIG. 11 is a perspective view of an attachment grip member.

Referring to FIG. 11, there is illustrated an attachment hand grip member 110 which, by way of example, has a hand grip 112 at one end and a ring 114 at its other end, the ring 114 and hand grip 112 being connected by connecting means such as a strap 116. The ring 114 is connected onto the snap fastener 90.

In one type of exercise, the exercise device 10 is held in one hand as illustrated in FIGS. 7 and 8 and the other hand grips the hand grip 112 and pulls on the cable 88 to exercise the arm of that hand. The exercise device 10 can be held in front of the user and the cable 88 pulled to one side, the exercise device can be held low and the cable 88 pulled upwardly, the exercise device can be held high and the cable 88 pulled downward, or to increase difficulty, the exercise device can be held behind the user and the pulley exercise with the other hand be performed behind the user. The exercise device can be held in either hand so that each arm is exercise.

Referring to FIGS. 12 through 18, the exercise device 10 can be wrapped around a leg or ankle as illustrated in FIGS. 9 and 10 and various pulley exercise performed. Also, two exercise devices 10 can be used at the same time with a given exercise device 10 wrapped around a given leg or ankle as illustrated in FIGS. 14 through 18. A wrist band has means by which the snap fastener or attachment means at the end of the cable is attached.

Figure 19:
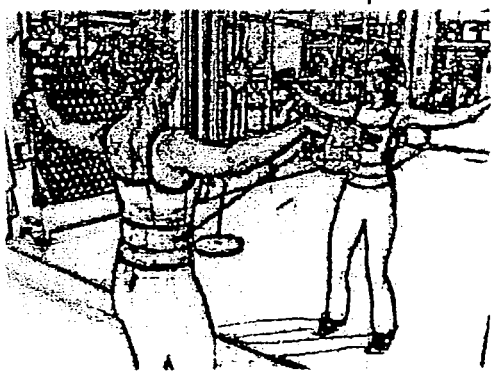
FIG. 19 is an illustrative view of an exercise being performed with two exercise devices, with the two devices held in the user's hand and respectively attached to a belt worn around the user's waist.

Referring to FIG. 19, the strap fastener 90 can be attached to a belt 120 worn around the waist with the exercise device 10 held in the hand as illustrated in FIGS. 7 and 8. The belt has means by which the snap fastener or attachment means at the end of the cable is attached.

Figure 20:
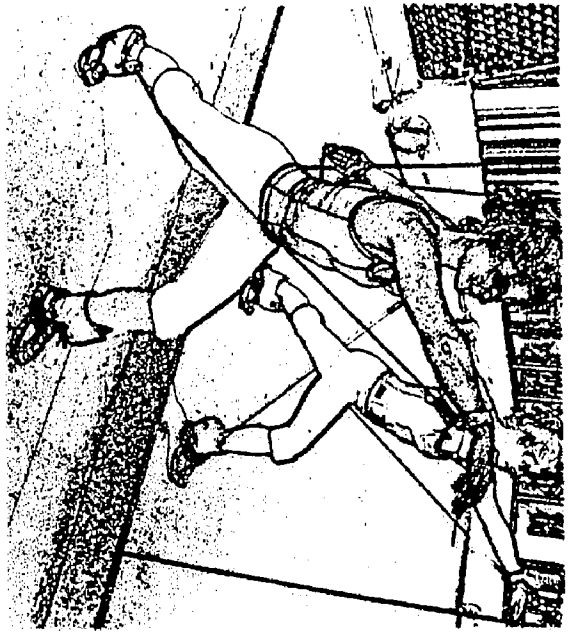
FIG. 20 is an illustrative view of another exercise being performed with two exercise devices, with the two devices attached to the user's legs and the cords attached to a wrist strap.
Figure 17:
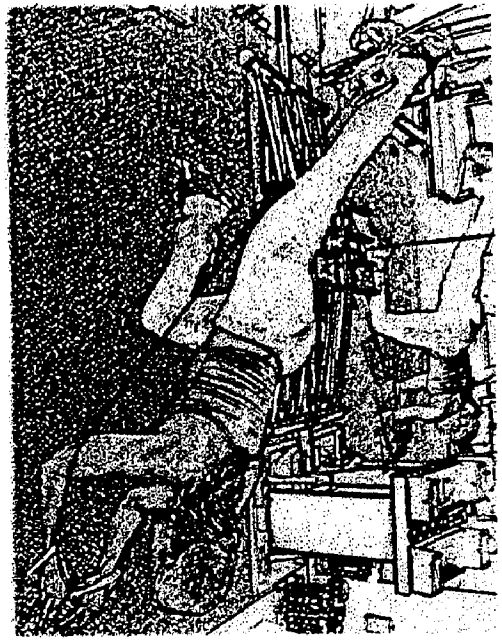
FIG. 17 is an illustrative view of an exercise being performed with two exercise devices, with an exercise device attached around each leg and a user resting on his elbows, respectively holding the grip handle attached to the cord of the exercise device.
Figure 18:
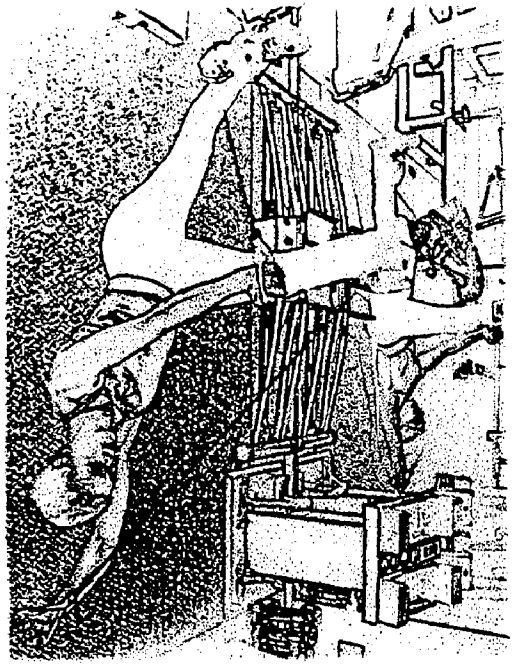
FIG. 18 is an illustrative view of an exercise being performed with two exercise devices, with an exercise device attached around each leg and the user on his back, holding the grip handles which are attached to each cord.

Referring to FIG. 20, the device is strapped around a user's leg and the strap fastener 90 is attached to a wrist strap.

In addition, to increase difficulty, the user can walk or jog while performing the exercises illustrated.

Defined in detail, the present invention is an exercise device, comprising: (a) an outer shell having a first half and a second half which are attached together to form an interior chamber, a first side edge, a bottom, a second side edge and a top; (b) a tension assembly comprising a tension bolt extending from the interior chamber through an opening in the top and terminating in a tension adjustment knob at one end which rests adjacent the top of the casing, a tension coil spring and a tension adjustment block each surrounding the tension bolt, a cotter pin extending through an opening in the tension bolt adjacent its end opposite the tension adjustment knob, the tension bolt supported within the interior chamber by a tension bolt support adjustment housing; (c) a pulley assembly within the internal chamber, the pulley assembly comprising a pulley shaft having a first sealed bearing at one end and a second sealed bearing at its opposite end, a pulley on said shaft, the pulley having a central opening, upper rim and a lower rim, a clock spring retainer plate located below the pulley with a clock spring wound around a clock spring pin attached to the retainer plate, the clock spring attached to the lower rim of the pulley at its opposite end, the pulley further having clutch retainer within the pulley's opening and a combination ball bearing one-way clutch retained by the clutch retainer so that the pulley is caused to spin in one direction by the combination ball bearing one-way clutch and can be recoiled in the other direction by the force of the clock spring, a brake wheel located on said pulley shaft and located above the pulley, a brake band around the brake wheel, the brake band attached to the tension bolt support adjustment housing at one end and attached to the tension adjustment block at its other end, so that resistance of the pulley can be adjusted; (d) a cable affixed to said pulley at one end, the cable extending out of a second opening in the top of the casing, the cable extending between a redirection pulley and a swivel pin which can be located in a redirection swivel located outside the casing adjacent the top of the casing, the pulley terminating in a snap fastener at its and; and (e) strap attachment means located on the exterior surface of the casing on the first side edge and the second side edge, and an attachment strap supported on the strap attachment means, the strap being affixed to the casing at one end and having attachment means at its other end by which the tension of the strap adjacent a body part is adjusted.

Defined broadly, the present invention is an exercise device, comprising: (a) an outer shell surrounding an interior chamber, the shell having a top and circumferential sides; (b) a tension assembly comprising a tension adjustment knob located outside said casing and adjacent its top, and a tension adjustment assembly within the chamber, including a tension bolt supporting a spring means and an adjustment block, the tension bolt supported within the chamber by a tension bolt support adjustment housing, the tension bolt attached at one end to the tension adjustment knob; (c) a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake wheel supported on the pulley shaft and surrounded by a brake band attached to the tension assembly by which resistance on the pulley can be adjusted; (d) a cable attached to the pulley at one end and extending out of the casing through an opening and terminating in an attachment means at its outer end, the cable extending through a multidirectional bearing which allows the cable to be pulled in a full 360 degree range of motion;

and (e) body attachment means affixed to the exterior of said casing by which the exercise device is removably attached to a body part of a user.

Defined more broadly, the present invention is an exercise device, comprising: (a) an outer shell surrounding an interior chamber, the shell having a top and circumferential sides; (b) a tension assembly comprising a tension adjustment knob located outside said casing and adjacent its top, and a tension adjustment assembly within the chamber, including a tension bolt supporting a spring means and an adjustment block, the tension bolt supported within the chamber by a tension bolt support adjustment housing, the tension bolt attached at one end to the tension adjustment knob; (c) a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake wheel supported on the pulley shaft and surrounded by a brake band attached to the tension assembly by which resistance on the pulley can be adjusted; and (d) a cable attached to the pulley at one end and extending out of the casing through an opening and terminating in an attachment means at its outer end, the cable extending through a multidirectional bearing which allows the cable to be pulled in a full 360 degree range of motion.

Defined even more broadly, the present invention is an exercise device, comprising: (a) an outer shell surrounding an interior chamber, the shell having a top and circumferential sides; (b) a tension adjustment assembly having a tension adjustment member located outside said casing and connected to tension adjustment means located within the interior chamber; (c) a pulley assembly within the internal chamber comprising a pulley having a combination ball bearing one-way clutch positioned on a shaft so the pulley is caused to spin in one direction, resistance means supported on said shaft and connected to the tension adjustment assembly, and force return means connected to said pulley to cause it to rotate in an opposite direction from said spin; and (d) elongated cord means attached to the pulley at one end and extending out of the casing through an opening and terminating in an attachment means at its other end, the elongated cord means extending through a multidirectional bearing which allows the elongated cord means to be pulled in a full 360 degree range of motion.

Defined alternatively in detail, the present invention is an exercise device, comprising: (a) an outer shell having a first half and a second half which are attached together to form an interior chamber, a first side edge, a bottom, a second side edge and a top; (b) a tension assembly comprising a tension bolt extending from the interior chamber through an opening in the top and terminating in a tension adjustment knob at one end which rests adjacent the top of the casing, a tension coil spring surrounding the tension bolt, the tension bolt supported within the interior chamber; (c) a pulley assembly within the internal chamber, the pulley assembly comprising a pulley shaft having a first sealed bearing at one end and a second sealed bearing at its opposite end, a pulley on said shaft, the pulley having a central opening, upper rim and a lower rim, a clock spring retainer plate located below the pulley with a clock spring wound around a clock spring pin attached to the retainer plate, the clock spring attached to the lower rim of the pulley at its opposite end, the pulley further having clutch retainer within the pulley's opening and a combination ball bearing one-way clutch retained by the clutch retainer so that the pulley is caused to spin in one direction by the combination ball bearing one-way clutch and can be recoiled in the other direction by the force of the clock spring, a brake bushing located on said pulley shaft and located above the pulley, a brake clamp around the brake bushing, the brake clamp attached to the tension bolt through openings in each end of the brake clamp, so that resistance of the pulley can be adjusted; (d) a cable affixed to said pulley at one end, the cable extending out of a second opening in the top of the casing, the cable extending between a redirection pulley and a swivel pin which can be located in a redirection swivel located outside the casing adjacent the top of the casing, the pulley terminating in a snap fastener at its and; and (e) strap attachment means located on the exterior surface of the casing on the first side edge and the second side edge, and an attachment strap supported on the strap attachment means, the strap being affixed to the casing at one end and having attachment means at its other end by which the tension of the strap adjacent a body part is adjusted.

Defined alternatively with a broader definition, the present invention is an exercise device, comprising: (a) an outer shell surrounding an interior chamber, the shell having a top and circumferential sides; (b) a tension assembly comprising a tension adjustment knob located outside said casing and adjacent its top, and a tension adjustment assembly within the chamber, including a tension bolt supporting a spring means, the tension bolt supported within the chamber, the tension bolt attached at one end to the tension adjustment knob; (c) a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake bushing supported on the pulley shaft and surrounded by a brake clamp attached to the tension assembly by which resistance on the pulley can be adjusted; (d) a cable attached to the pulley at one end and extending out of the casing through an opening and terminating in an attachment means at its outer end, the cable extending through a multidirectional bearing which allows the cable to be pulled in a full 360 degree range of motion; and (e) body attachment means affixed to the exterior of said casing by which the exercise device is removably attached to a body part of a user.

Defined alternatively and most broadly, the present invention is an exercise device, comprising: (a) an outer shell surrounding an interior chamber, the shell having a top and circumferential sides; (b) a tension assembly comprising a tension adjustment knob located outside said casing and adjacent its top, and a tension adjustment assembly within the chamber, including a tension bolt supporting a spring means, the tension bolt supported within the chamber, the tension bolt attached at one end to the tension adjustment knob; (c) a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake bushing supported on the pulley shaft and surrounded by a brake clamp attached to the tension assembly by which resistance on the pulley can be adjusted; and (d) a cable attached to the pulley at one end and extending out of the casing through an opening and terminating in an attachment means at its outer end, the cable extending through a multidirectional bearing which allows the cable to be pulled in a full 360 degree range of motion.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention.

What is claimed is:

1. An exercise device, comprising:

a. an outer shell having a first half and a second half which are attached together to form an interior chamber, a first side edge, a bottom, a second side edge and a top;

b. a tension assembly comprising a tension bolt extending from the interior chamber through an opening in the top and terminating in a tension adjustment knob at one end which rests adjacent the top of the casing, a tension coil spring and a tension adjustment block each surrounding the tension bolt, a cotter pin extending through an opening in the tension bolt adjacent its end opposite the tension adjustment knob, the tension bolt supported within the interior chamber by a tension bolt support adjustment housing;

c. a pulley assembly within the internal chamber, the pulley assembly comprising a pulley shaft having a first sealed bearing at one end and a second sealed bearing at its opposite end, a pulley on said shaft, the pulley having a central opening, upper rim and a lower rim, a clock spring retainer plate located below the pulley with a clock spring wound around a clock spring pin attached to the retainer plate, the clock spring attached to the lower rim of the pulley at its opposite end, the pulley further having a clutch retainer within the pulley's opening and a combination ball bearing one-way clutch retained by the clutch retainer so that the pulley is caused to spin in one direction by the combination ball bearing one-way clutch and can be recoiled in the other direction by the force of the clock spring, a brake wheel located on said pulley shaft and located above the pulley, a brake band around the brake wheel, the brake band attached to the tension bolt support adjustment housing at one end and attached to the tension adjustment block at its other end, so that resistance of the pulley can be adjusted;

d. a cable affixed to said pulley at one end, the cable extending out of a second opening in the top of the casing, the cable extending between a redirection pulley and a swivel pin which can be located in a redirection swivel located outside the casing adjacent the top of the casing, the pulley terminating in a snap fastener at its and; and e. a strap attachment located on the exterior surface of the casing on the first side edge and the second side edge, and an attachment strap supported on the strap attachment, the strap being affixed to the casing at one end and having an adjustable attachment at its other end by which the tension of the strap adjacent a body part is adjusted.

2. An exercise device in accordance with claim 1, further comprising a hand grip attached to the snap fastener on said cable.

3. An exercise device in accordance with claim 1, further comprising a belt worn around the waist to which the snap fastener of said cable is attached.

4. An exercise device in accordance with claim 1, further comprising a wrist band to which the snap fastener of said cable is attached.

5. An exercise device, comprising:

a. an outer shell surrounding an interior chamber, the shell having a top and circumferential sides;

b. a tension assembly comprising a tension adjustment knob located outside said casing and adjacent its top, and a tension adjustment assembly within the chamber, including a tension bolt supporting a spring and an adjustment block, the tension bolt supported within the chamber by a tension bolt support adjustment housing, the tension bolt attached at one end to the tension adjustment knob;

c. a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake wheel supported on the pulley shaft and surrounded by a brake band attached to the tension assembly by which resistance on the pulley can be adjusted;

d. a cable attached to the pulley at one end and extending out of the casing through an opening and terminating in an attachment at its outer end, the cable extending through a multidirectional bearing which allows the cable to be pulled in a full 360 degree range of motion; and e. a body attachment affixed to the exterior of said casing by which the exercise device is removably attached to a body part of a user.

6. An exercise device in accordance with claim 5, further comprising a hand grip attached to the snap fastener on said cable.

7. An exercise device in accordance with claim 5, further comprising a belt worn around the waist to which the attachment of said cable is attached.

8. An exercise device in accordance with claim 5, further comprising a wrist band to which the attachment of said cable is attached.

9. An exercise device, comprising:

a. an outer shell surrounding an interior chamber, the shell having a top and circumferential sides;

b. a tension assembly comprising a tension adjustment knob located outside said casing and adjacent its top, and a tension adjustment assembly within the chamber, including a tension bolt supporting a spring and an adjustment block, the tension bolt supported within the chamber by a tension bolt support adjustment housing, the tension bolt attached at one end to the tension adjustment knob;

c. a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake wheel supported on the pulley shaft and surrounded by a brake band attached to the tension assembly by which resistance on the pulley can be adjusted; and d. a cable attached to the pulley at one end and extending out of the casing through an opening and terminating in an attachment at its outer end, the cable extending through a multidirectional bearing which allows the cable to be pulled in a full 360 degree range of motion.

10. An exercise device, comprising:

a. an outer shell surrounding an interior chamber, the shell having a top and circumferential sides;

b. a tension adjustment assembly having a tension adjustment member located outside said casing and connected to tension adjustment located within the interior chamber;

c. a pulley assembly within the internal chamber comprising a pulley having a combination ball bearing one-way clutch positioned on a shaft so the pulley is caused to spin in one direction, a resistance supported on said shaft and connected to the tension adjustment assembly, and a force return connected to said pulley to cause it to rotate in an opposite direction from said spin; and d. an elongated cord attached to the pulley at one end and extending out of the casing through an opening and terminating in an attachment at its other end, the elongated cord extending through a multidirectional bearing which allows the elongated cord to be pulled in a full 360 degree range of motion.

11. The exercise device in accordance with claim 10, further comprising a body attachment affixed to the exterior of said casing by which the exercise device is removably attached to a body part of a user.

12. An exercise device, comprising:

a. an outer shell having a first half and a second half which are attached together to form an interior chamber, a first side edge, a bottom, a second side edge and a top;

b. a tension assembly comprising a tension bolt extending from the interior chamber through an opening in the top and terminating in a tension adjustment knob at one end which rests adjacent the top of the casing, a tension coil spring surrounding the tension bolt, the tension bolt supported within the interior chamber;

c. a pulley assembly within the internal chamber, the pulley assembly comprising a pulley shaft having a first sealed bearing at one end and a second sealed bearing at its opposite end, a pulley on said shaft, the pulley having a central opening, upper rim and a lower rim, a clock spring retainer plate located below the pulley with a clock spring wound around a clock spring pin attached to the retainer plate, the clock spring attached to the lower rim of the pulley at its opposite end, the pulley further having a clutch retainer within the pulley's opening and a combination ball bearing one-way clutch retained by the clutch retainer so that the pulley is caused to spin in one direction by the combination ball bearing one-way clutch and can be recoiled in the other direction by the force of the clock spring, a brake bushing located on said pulley shaft and located above the pulley, a brake clamp around the brake bushing, the brake clamp attached to the tension bolt through openings in each end of the brake clamp, so that resistance of the pulley can be adjusted;

d. a cable affixed to said pulley at one end, the cable extending out of a second opening in the top of the casing, the cable extending between a redirection pulley and a swivel pin which can be located in a redirection swivel located outside the casing adjacent the top of the casing, the pulley terminating in a snap fastener at its and; and e. a strap attachment located on the exterior surface of the casing on the first side edge and the second side edge, and an attachment strap supported on the strap attachment, the strap being affixed to the casing at one end and having an attachment at its other end by which the tension of the strap adjacent a body part is adjusted.

13. An exercise device in accordance with claim 12, further comprising a hand grip attached to the snap fastener on said cable.

14. An exercise device in accordance with claim 12, further comprising a belt worn around the waist to which the snap fastener of said cable is attached.

15. An exercise device in accordance with claim 12, further comprising a wrist band to which the snap fastener of said cable is attached.

16. An exercise device, comprising:

a. an outer shell surrounding an interior chamber, the shell having a top and circumferential sides;

b. a tension assembly comprising a tension adjustment knob located outside said casing and adjacent its top, and a tension adjustment assembly within the chamber, including a tension bolt supporting a spring, the tension bolt supported within the chamber, the tension bolt attached at one end to the tension adjustment knob;

c. a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake bushing supported on the pulley shaft and surrounded by a brake clamp attached to the tension assembly by which resistance on the pulley can be adjusted;

d. a cable attached to the pulley at one end and extending out of the casing through an opening and terminating in an attachment at its outer end, the cable extending through a multidirectional bearing which allows the cable to be pulled in a full 360 degree range of motion; and e. a body attachment affixed to the exterior of said casing by which the exercise device is removably attached to a body part of a user.

17. An exercise device in accordance with claim 16, further comprising a hand grip attached to the snap fastener on said cable.

18. An exercise device in accordance with claim 16, further comprising a belt worn around the waist to which the attachment of said cable is attached.

19. An exercise device in accordance with claim 16, further comprising a wrist band to which the attachment of said cable is attached.

20. An exercise device, comprising:

a. an outer shell surrounding an interior chamber, the shell having a top and circumferential sides;

b. a tension assembly comprising a tension adjustment knob located outside said casing and adjacent its top, and a tension adjustment assembly within the chamber, including a tension bolt supporting a spring, the tension bolt supported within the chamber, the tension bolt attached at one end to the tension adjustment knob;

c. a pulley assembly within the internal chamber, the pulley assembly comprising a pulley shaft supported by ball bearings, the pulley positioned on the pulley shaft through a combination ball bearing one-way clutch so that the pulley is caused to spin in one direction, a return spring attached to the pulley to cause it to rewind, a brake bushing supported on the pulley shaft and surrounded by a brake clamp attached to the tension assembly by which resistance on the pulley can be adjusted; and d. a cable attached to the pulley at one end and extending out of the casing through an opening and terminating in an attachment at its outer end, the cable extending through a multidirectional bearing which allows the cable to be pulled in a full 360 degree range of motion.

* * * * *